US009463900B2

(12) United States Patent
Nakayama et al.

(10) Patent No.: US 9,463,900 B2
(45) **Date of Patent: *Oct. 11, 2016**

(54) BOTTLE MADE FROM SYNTHETIC RESIN MATERIAL AND FORMED IN A CYLINDRICAL SHAPE HAVING A BOTTOM PORTION

(75) Inventors: Tadayori Nakayama, Tokyo (JP); Hiromichi Saito, Tokyo (JP); Takao Iizuka, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 166 days.

This patent is subject to a terminal disclaimer.

(21) Appl. No.: 13/818,200

(22) PCT Filed: Sep. 22, 2011

(86) PCT No.: PCT/JP2011/071572

§ 371 (c)(1),
(2), (4) Date: Feb. 21, 2013

(87) PCT Pub. No.: WO2012/043359

PCT Pub. Date: Apr. 5, 2012

(65) Prior Publication Data

US 2013/0153529 A1 Jun. 20, 2013

(30) Foreign Application Priority Data

Sep. 30, 2010 (JP) ..... 2010-220703

(51) Int. Cl.
*B65D 1/02* (2006.01)
*B65D 90/02* (2006.01)
(Continued)

(52) U.S. Cl.
CPC ..... *B65D 23/001* (2013.01); *B65D 1/0276* (2013.01); *B65D 79/005* (2013.01); *B65D 2501/0036* (2013.01)

(58) Field of Classification Search
CPC B65D 23/001; B65D 79/05; B65D 21/0231; B65D 90/02; B65D 1/02
USPC ..... 215/370–373, 376, 381, 382; 220/604–606, 608, 609
See application file for complete search history.

(56) References Cited

U.S. PATENT DOCUMENTS 91,754 A * 6/1869 Lawrence ..... 126/390.1
163,747 A * 5/1875 Cummings ..... 126/390.1
(Continued)

FOREIGN PATENT DOCUMENTS

CA 1157785 A 11/1983
EP 2623426 A1 8/2013
(Continued)

OTHER PUBLICATIONS

Dec. 13, 2011 Search Report issued in International Patent Application No. PCT/JP2011/071572 (with translation).
(Continued)

*Primary Examiner* — Anthony Stashick
*Assistant Examiner* — Raven Collins
(74) *Attorney, Agent, or Firm* — Oliff PLC

(57) ABSTRACT

A bottle including a bottom portion including a heel portion, and a bottom wall portion, wherein the bottom wall portion includes a rising circumferential wall portion continuing into the ground portion and extending upward, a movable wall portion having an annular shape and protruding toward the inside in the radial direction of the bottle, and a recessed circumferential wall portion extending upward from an inner edge portion of the movable wall portion in the radial direction of the bottle. The movable wall portion is freely rotatably provided having a connected portion with the rising circumferential wall portion as a center so as to move the recessed circumferential wall portion upward. A lower heel edge portion continuing into the grounding portion is formed in a smaller diameter than an upper heel portion continuing into the lower heel edge portion from an upper side.

2 Claims, 3 Drawing Sheets

(51) Int. Cl.
*B65D 23/00* (2006.01)
*B65D 79/00* (2006.01)

(56) References Cited

U.S. PATENT DOCUMENTS

| | | | | |
|---|---|---|---|---|
| 3,081,002 | A * | 3/1963 | Tauschinski et al. | 222/105 |
| 3,400,853 | A * | 9/1968 | Jacobsen | 220/624 |
| 3,409,167 | A * | 11/1968 | Blanchard | 220/609 |
| 3,482,724 | A * | 12/1969 | Heaton | 215/10 |
| 3,483,908 | A * | 12/1969 | Donovan | 221/260 |
| 3,956,441 | A * | 5/1976 | Uhlig | 264/530 |
| 3,979,009 | A * | 9/1976 | Walker | 220/609 |
| 4,125,632 | A * | 11/1978 | Vosti et al. | 426/111 |
| 4,134,510 | A * | 1/1979 | Chang | 215/373 |
| 4,147,271 | A * | 4/1979 | Yamaguchi | 220/606 |
| 4,174,782 | A * | 11/1979 | Obsomer | 215/373 |
| 4,249,666 | A * | 2/1981 | Hubert et al. | 215/373 |
| 4,407,421 | A * | 10/1983 | Waugh | 215/12.2 |
| 4,442,944 | A * | 4/1984 | Yoshino et al. | 215/376 |
| 4,444,308 | A * | 4/1984 | MacEwen | 206/249 |
| 4,542,029 | A | 9/1985 | Caner et al. | |
| 4,798,300 | A | 1/1989 | Ghosh et al. | |
| 4,836,398 | A | 6/1989 | Leftault, Jr. et al. | |
| 4,880,129 | A * | 11/1989 | McHenry et al. | 220/609 |
| 4,892,205 | A * | 1/1990 | Powers et al. | 215/375 |
| 5,005,716 | A * | 4/1991 | Eberle | 215/373 |
| 5,080,244 | A | 1/1992 | Yoshino | |
| 5,407,086 | A * | 4/1995 | Ota et al. | 215/383 |
| 5,492,245 | A * | 2/1996 | Kalkanis | 220/609 |
| 5,503,283 | A * | 4/1996 | Semersky | 215/375 |
| 5,593,063 | A * | 1/1997 | Claydon et al. | 220/608 |
| 5,648,133 | A * | 7/1997 | Suzuki et al. | 428/36.92 |
| 5,713,480 | A * | 2/1998 | Petre et al. | 215/373 |
| 5,908,128 | A * | 6/1999 | Krishnakumar et al. | 215/381 |
| 6,065,624 | A * | 5/2000 | Steinke | 215/383 |
| 6,277,321 | B1 * | 8/2001 | Vailliencourt et al. | 264/529 |
| 6,409,035 | B1 * | 6/2002 | Darr et al. | 215/373 |
| D471,449 | S * | 3/2003 | Bezek et al. | D9/428 |
| 6,569,376 | B2 * | 5/2003 | Wurster et al. | 264/523 |
| 6,585,123 | B1 * | 7/2003 | Pedmo et al. | 215/10 |
| 6,595,380 | B2 * | 7/2003 | Silvers | 215/373 |
| 6,612,451 | B2 * | 9/2003 | Tobias et al. | 215/375 |
| 6,635,217 | B1 | 10/2003 | Britton | |
| 6,672,470 | B2 * | 1/2004 | Wurster et al. | 215/373 |
| 6,896,147 | B2 * | 5/2005 | Trude | 215/373 |
| 6,942,116 | B2 * | 9/2005 | Lisch et al. | 215/373 |
| 6,997,336 | B2 * | 2/2006 | Yourist et al. | 215/379 |
| 7,017,763 | B2 * | 3/2006 | Kelley | 215/383 |
| 7,140,505 | B2 * | 11/2006 | Roubal et al. | 215/373 |
| 7,150,372 | B2 * | 12/2006 | Lisch et al. | 215/373 |
| 7,451,886 | B2 * | 11/2008 | Lisch et al. | 215/373 |
| 7,543,713 | B2 * | 6/2009 | Trude et al. | 215/373 |
| 7,552,833 | B2 * | 6/2009 | Tsutsui et al. | 215/381 |
| 7,552,834 | B2 * | 6/2009 | Tanaka et al. | 215/381 |
| 7,556,164 | B2 * | 7/2009 | Tanaka et al. | 215/373 |
| 7,574,846 | B2 * | 8/2009 | Sheets et al. | 53/440 |
| 7,732,035 | B2 * | 6/2010 | Pedmo et al. | 428/66.3 |
| 7,748,553 | B2 * | 7/2010 | Akiyama et al. | 215/382 |
| 7,799,264 | B2 * | 9/2010 | Trude | 264/524 |
| 7,900,425 | B2 * | 3/2011 | Bysick et al. | 53/440 |
| 7,926,243 | B2 * | 4/2011 | Kelley et al. | 53/440 |
| 8,011,166 | B2 * | 9/2011 | Sheets et al. | 53/127 |
| 8,047,388 | B2 * | 11/2011 | Kelley et al. | 215/373 |
| 8,075,833 | B2 * | 12/2011 | Kelley | 264/534 |
| 8,096,098 | B2 * | 1/2012 | Kelley et al. | 53/486 |
| 8,152,010 | B2 * | 4/2012 | Melrose | 215/373 |
| 8,171,701 | B2 * | 5/2012 | Kelley et al. | 53/127 |
| 8,181,804 | B2 * | 5/2012 | Lane | 215/374 |
| 8,205,749 | B2 * | 6/2012 | Korpanty et al. | 206/508 |
| 8,276,774 | B2 * | 10/2012 | Patcheak et al. | 215/373 |
| 8,353,415 | B2 * | 1/2013 | Saito et al. | 215/373 |
| 8,429,880 | B2 * | 4/2013 | Kelley et al. | 53/127 |
| 8,505,756 | B2 * | 8/2013 | Saito et al. | 215/376 |
| 8,584,879 | B2 * | 11/2013 | Melrose et al. | 215/373 |
| 8,590,729 | B2 * | 11/2013 | Kamineni et al. | 220/609 |
| 8,636,944 | B2 * | 1/2014 | Kelley et al. | 264/534 |
| 9,085,387 | B2 | 7/2015 | Kurihara et al. | |
| 2002/0063105 | A1 * | 5/2002 | Darr et al. | 215/373 |
| 2002/0153343 | A1 * | 10/2002 | Tobias et al. | 215/375 |
| 2004/0159626 | A1 * | 8/2004 | Trude | 215/373 |
| 2004/0164045 | A1 * | 8/2004 | Kelley | 215/373 |
| 2004/0211746 | A1 * | 10/2004 | Trude | 215/374 |
| 2004/0232103 | A1 * | 11/2004 | Lisch et al. | 215/374 |
| 2005/0045645 | A1 * | 3/2005 | Tsutsui et al. | 220/669 |
| 2005/0082250 | A1 * | 4/2005 | Tanaka et al. | 215/374 |
| 2005/0196569 | A1 * | 9/2005 | Lisch et al. | 428/35.7 |
| 2006/0006133 | A1 * | 1/2006 | Lisch et al. | 215/374 |
| 2006/0113274 | A1 * | 6/2006 | Keller et al. | 215/376 |
| 2006/0138074 | A1 * | 6/2006 | Melrose | 215/373 |
| 2006/0138075 | A1 * | 6/2006 | Roubal et al. | 215/373 |
| 2006/0231985 | A1 * | 10/2006 | Kelley | 264/523 |
| 2007/0039918 | A1 * | 2/2007 | Lane et al. | 215/381 |
| 2007/0084821 | A1 * | 4/2007 | Bysick et al. | 215/373 |
| 2007/0181403 | A1 * | 8/2007 | Sheets et al. | 198/617 |
| 2007/0199915 | A1 * | 8/2007 | Denner et al. | 215/375 |
| 2007/0215571 | A1 * | 9/2007 | Trude | 215/373 |
| 2008/0029523 | A1 | 2/2008 | Tung et al. | |
| 2008/0047964 | A1 * | 2/2008 | Denner et al. | 220/624 |
| 2009/0159556 | A1 * | 6/2009 | Patcheak et al. | 215/373 |
| 2009/0202766 | A1 * | 8/2009 | Beuerle et al. | 428/36.9 |
| 2009/0242575 | A1 * | 10/2009 | Kamineni et al. | 220/608 |
| 2010/0133228 | A1 * | 6/2010 | Trude | 215/370 |
| 2010/0140838 | A1 * | 6/2010 | Kelley et al. | 264/268 |
| 2010/0170199 | A1 * | 7/2010 | Kelley et al. | 53/440 |
| 2010/0170200 | A1 * | 7/2010 | Kelley et al. | 53/440 |
| 2010/0219152 | A1 * | 9/2010 | Derrien et al. | 215/374 |
| 2011/0017700 | A1 * | 1/2011 | Patcheak et al. | 215/381 |
| 2011/0113731 | A1 * | 5/2011 | Bysick et al. | 53/440 |
| 2011/0185677 | A1 * | 8/2011 | Kelley et al. | 53/127 |
| 2011/0217494 | A1 * | 9/2011 | Lane | 428/35.7 |
| 2011/0233166 | A1 | 9/2011 | Hiromichi et al. | |
| 2011/0266293 | A1 * | 11/2011 | Kelley et al. | 220/672 |
| 2012/0012592 | A1 * | 1/2012 | Lisch et al. | 220/660 |
| 2012/0074151 | A1 * | 3/2012 | Gill et al. | 220/669 |
| 2012/0181246 | A1 * | 7/2012 | Ross et al. | 215/40 |
| 2012/0240515 | A1 * | 9/2012 | Kelley et al. | 53/127 |
| 2013/0206719 | A1 * | 8/2013 | Tanaka et al. | 215/381 |

FOREIGN PATENT DOCUMENTS

| | | | |
|---|---|---|---|
| JP | S56-150712 | U | 11/1981 |
| JP | H02-001614 | U | 1/1990 |
| JP | U 5-81009 | | 11/1993 |
| JP | A 2002-225834 | | 8/2002 |
| JP | 2004-276602 | A | 10/2004 |
| JP | 101005990 | A | 7/2007 |
| JP | 2008-132998 | A | 6/2008 |
| JP | 2009-018840 | A | 1/2009 |
| JP | A 2010-126184 | | 6/2010 |
| WO | WO 2009050346 | A1 * | 4/2009 |
| WO | WO 2010/061758 | A1 | 6/2010 |
| WO | WO 2010/129402 | A1 | 11/2010 |

OTHER PUBLICATIONS

Dec. 3, 2013 Notice of Reasons for Rejection issued in Japanese Patent Application No. 2010-220703 (with translation).

Feb. 25, 2014 Supplementary Search Report issued in European Patent Application No. 11828916.4.

Dec. 13, 2011 International Search Report issued in International Patent Application No. PCT/JP2011/071597.

Dec. 3, 2013 Notice of Allowance issued in Japanese Patent Application no. 2010-220706.

Feb. 25, 2014 Search Report issued in European Patent Application No. 11828928.9.

Apr. 11, 2014 Office Action issued in U.S. Appl. No. 13/824,872.

Jun. 4, 2014 Office Action issued in Chinese Patent Application No. 201180046839.3.

Aug. 28, 2015 Office Action issued in Taiwanese Patent Application No. 100134660.

* cited by examiner

BOTTLE MADE FROM SYNTHETIC RESIN MATERIAL AND FORMED IN A CYLINDRICAL SHAPE HAVING A BOTTOM PORTION

CLAIM FOR PRIORITY AND INCORPORATION BY REFERENCE

Priority is claimed on Japanese Patent Application No. 2010-220703 filed on Sep. 30, 2010, the content of which is incorporated herein by reference.

BACKGROUND OF THE INVENTION

1. Field of the Invention

The present invention relates to a bottle.

2. Background Art

In the related art, a configuration has been known in which, as a bottle formed of a synthetic resin material in the shape of a cylinder with a bottom portion of the bottle by blow molding, the bottom portion of the bottle includes a heel portion whose upper opening section is connected to a lower opening section of a body portion, and a bottom wall portion which blocks a lower opening section of the heel portion and whose outer circumferential edge serves as a grounding portion. The bottom wall portion includes a rising circumferential wall portion that stretches out from a radial inner side of the bottle at the grounding portion to extend upward, an annular movable wall portion that protrudes from an upper end of the rising circumferential wall portion toward the radial inner side of the bottle, and a recessed circumferential wall portion that extends upward from a radial inner end of the bottle of the movable wall portion; and the movable wall portion rotates about a connected portion with the rising circumferential wall portion so as to move the recessed circumferential wall portion in an upward direction, thereby absorbing decompression in the bottle (e.g., see Patent Document 1).

RELATED ART DOCUMENTS

Patent Document

[Patent Document 1] International Patent Application Publication No. 2010/061758 Pamphlet

BRIEF SUMMARY OF THE INVENTION

Problems to be Solved by the Invention

However, in the bottle of the related art, during the blow molding, sink marks occur at a lower heel edge portion of the heel portion which stretches out from a radial outer side of the bottle at the grounding portion, and thus the grounding portion is deformed, and there is a possibility of the ground-contact stability being impaired.

An object of the present invention is to provide a bottle capable of suppressing sink marks from occurring at a lower heel edge portion.

Means for Solving the Problems

According to a first aspect of the present invention, a bottle is made from synthetic resin material and is formed by blow-molding in a cylindrical shape having a bottom. A bottom portion of the bottle includes a heel portion having an upper opening portion which is connected to a lower opening section of a body portion, and a bottom wall portion having a circumferential edge configuring a grounding portion, the bottom wall portion closing a lower opening section of the heel portion. The bottom wall portion includes a rising circumferential wall portion continuing into the ground portion from an inside in a radial direction of the bottle and extending upward, a movable wall portion having an annular shape and protruding toward the inside in the radial direction of the bottle from an upper end portion of the rising circumferential wall portion, and a recessed circumferential wall portion extending upward from an inner edge portion of the movable wall portion in the radial direction of the bottle. The movable wall portion is freely rotatably provided having a connected portion with the rising circumferential wall portion as a center so as to move the recessed circumferential wall portion upward. A lower heel edge portion continuing into the grounding portion is formed in a smaller diameter than an upper heel portion continuing into the lower heel edge portion from an upper side.

According to the first aspect of the present invention, since the lower heel edge portion of the heel portion is formed with a smaller diameter than the upper heel portion, it is possible to suppress sink marks from occurring at the lower heel edge portion during the blow molding of the bottle, and to suppress deformation of the grounding portion stretching out at the lower heel edge portion.

Here, a connection part of the lower heel edge portion and the upper heel portion may be gradually reduced in diameter from an upper side toward a lower side thereof.

In this case, since the connection part of the lower heel edge portion and the upper heel portion is gradually reduced in diameter from the upper side toward the lower side thereof, good moldability is secured, and the aforementioned effects are reliably accomplished.

Effects of the Invention

According to the present invention, it is possible to suppress the sink marks from occurring at the lower heel edge portion.

DETAILED DESCRIPTION OF THE INVENTION

Hereinafter, an embodiment of the present invention will be described with reference to the accompanying drawings.

Figure 1:
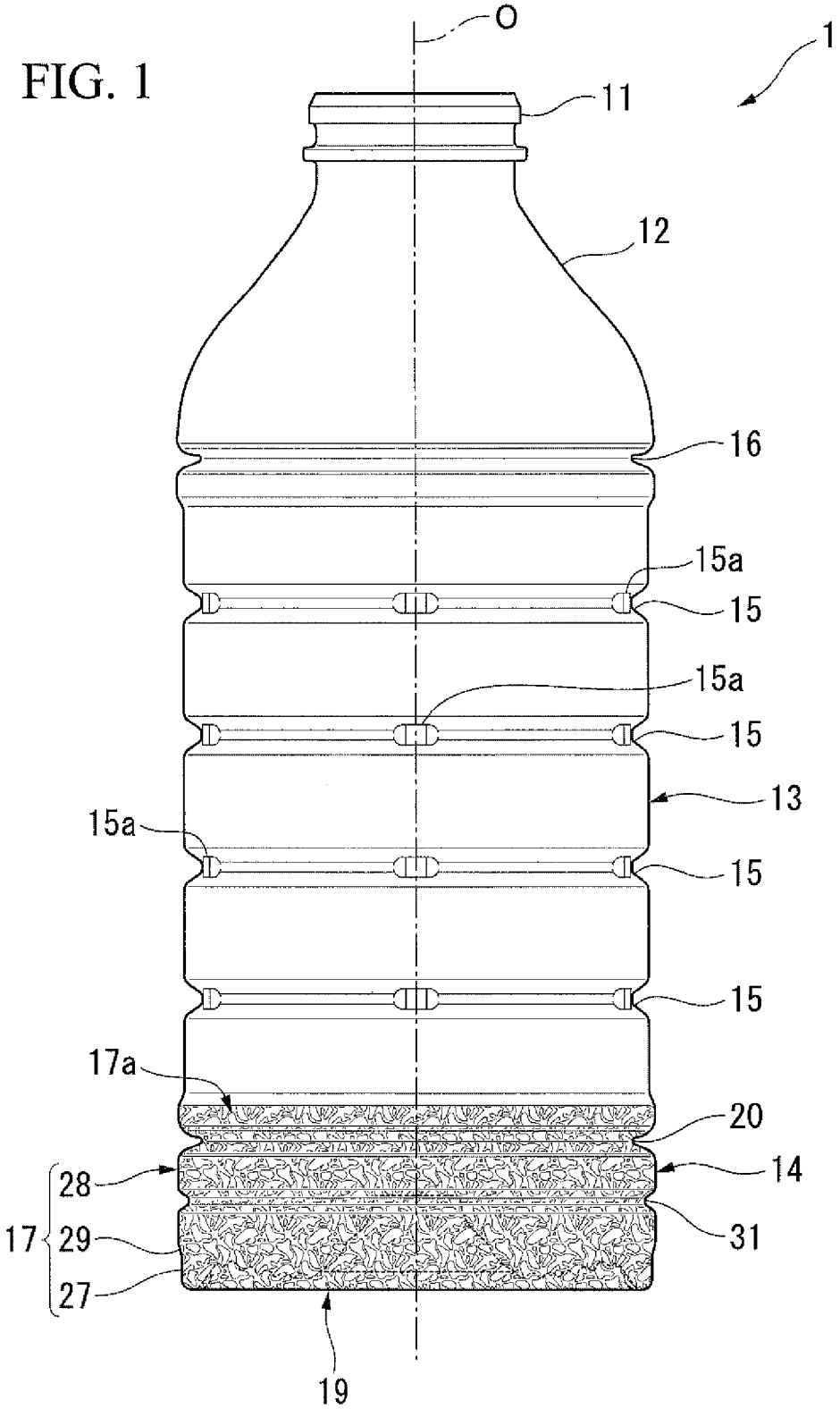
FIG. 1 is a side view of a bottle shown as an embodiment related to the present invention.
Figure 2:
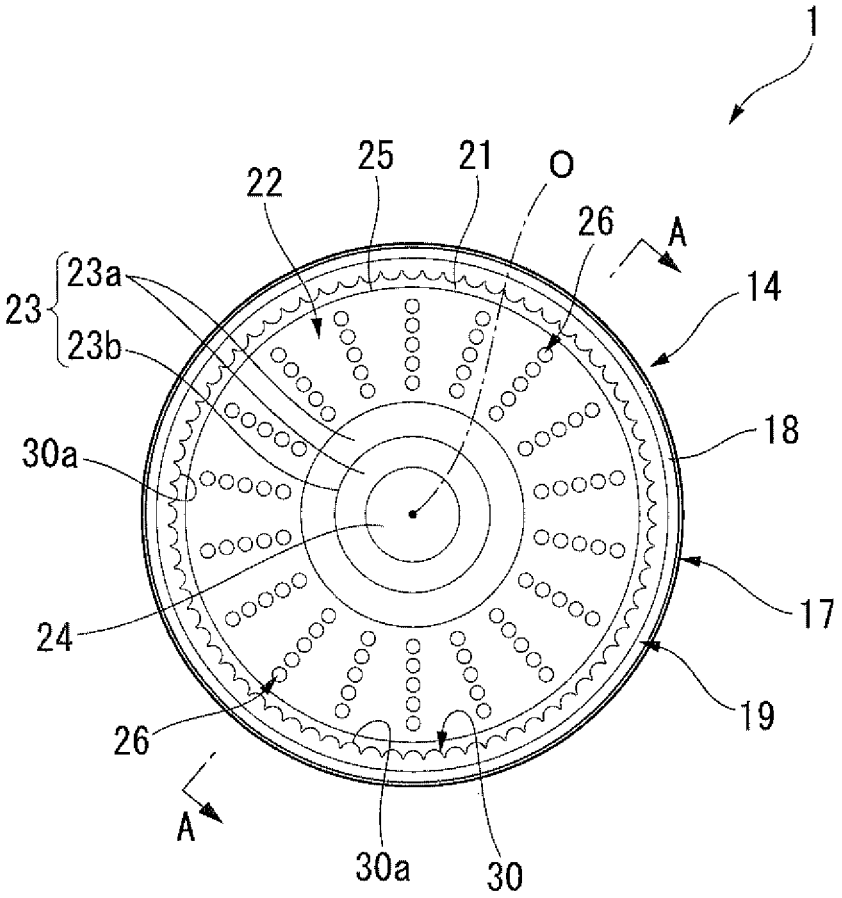
FIG. 2 is a bottom view of the bottle shown in FIG. 1.
Figure 3:
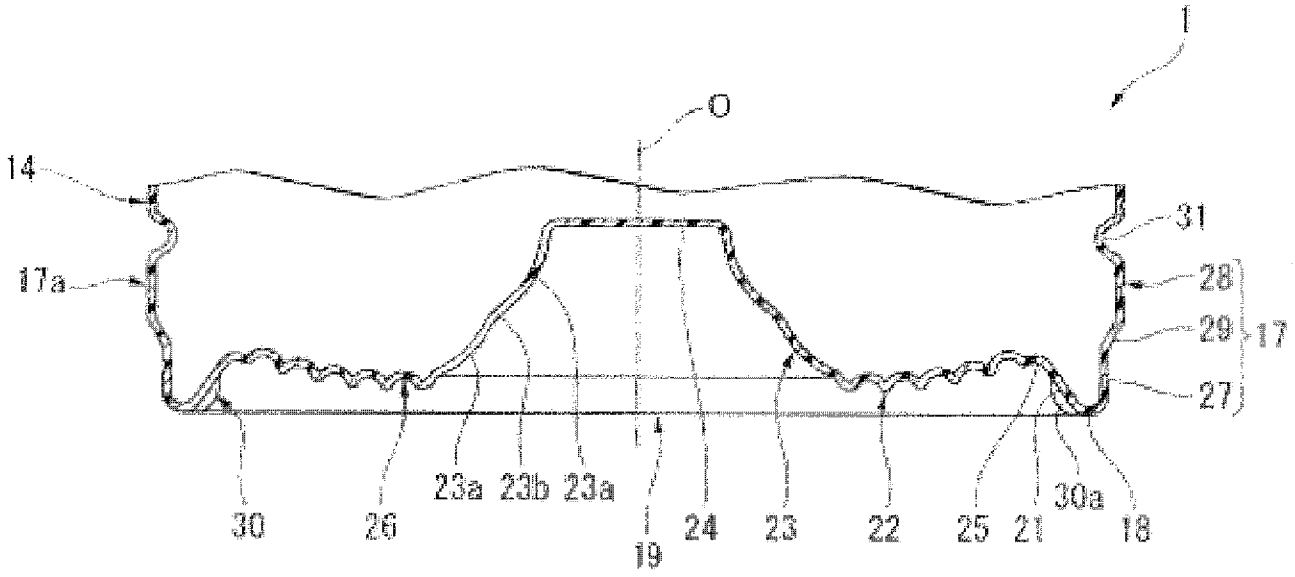
FIG. 3 is a cross-sectional view taken along arrow line A-A of the bottle shown in FIG. 2.

As shown in FIGS. 1 to 3, a bottle 1 according to the present embodiment includes a mouth portion 11, a shoulder portion 12, a body portion 13, and a bottom portion 14. These parts 11 to 14 are connected in that order with each central axis located on a common axis.

Hereinafter, the common axis is referred to as a bottle axis O, and a side of the mouth portion 11 and a side of the bottom portion 14 of the bottle 1 along a direction of the bottle axis O are referred to as an upper side and a lower side, respectively. Further, directions perpendicular to the bottle axis O are referred to as radial directions of the bottle, and a direction revolving around the bottle axis O is referred to as a circumferential direction of the bottle.

Further, the bottle 1 is formed of a pre-form, which is formed in the shape of a bottomed cylinder by injection molding, by blow molding, and is integrally formed of a synthetic resin material. Further, the mouth portion 11 is mounted with a cap, which is not shown. Furthermore, each of the mouth portion 11, the shoulder portion 12, the body portion 13, and the bottom portion 14 of the bottle 1 has a circular shape when viewed from a cross section perpendicular to the bottle axis O.

A connected portion of the shoulder portion 12 and the body portion 13 is continuously formed with a first annular concave groove 16 throughout the circumference thereof.

The body portion 13 is formed in a cylindrical shape. Between opposite ends of the direction of the bottle axis O, the body portion 13 is formed with a smaller diameter than the opposite ends. The body portion 13 is continuously formed with a plurality of second annular concave grooves 15 throughout the circumference thereof at intervals in the direction of the bottle axis O. In each second annular concave groove 15, a plurality of reinforcement protrusions 15*a* protrude toward a radial outer side of the bottle at intervals in a circumferential direction. In each of the plurality of second annular concave grooves 15, the plurality of reinforcement protrusions 15*a* have the same positions along the circumferential direction of the bottle in which they are disposed. Further, the reinforcement protrusions 15*a* are located at a radial inner side of the bottle from an outer circumferential surface of the body portion 13.

A connected portion of the body portion 13 and the bottom portion 14 of the bottle 1 is continuously formed with a third annular concave groove 20 throughout the circumference thereof.

The bottom portion 14 of the bottle 1 is formed in the shape of a cup having a heel portion 17 whose upper opening section is connected to a lower opening section of the body portion 13 and a bottom wall portion 19 which blocks a lower opening section of the heel portion 17 and whose outer circumferential edge serves as a grounding portion 18.

The heel portion 17 is continuously formed with a fourth annular concave groove 31, which is shallower in a depth than the third annular concave groove 20, throughout the circumference thereof.

Moreover, in the present embodiment, an outer circumferential surface of the entire heel portion 17 and an outer circumferential surface of a lower end of the body portion 13 are formed with an uneven section 17*a*. Thereby, when a plurality of bottles 1 are being conveyed in a row in a filling process, each of the outer circumferential surfaces of the heel portion 17 and each of the outer circumferential surfaces of the lower ends of the body portion 13 of neighboring bottles 1 contact each other and it can allow the bottles 1 to slide against each other. As a result, the occurrence of so-called blocking is inhibited. Further, in the example shown in FIG. 1, a surface of the third annular concave groove 20 and a surface of the fourth annular concave groove 31 are also formed with the uneven section 17*a*.

As shown in FIG. 3, the bottom wall portion 19 includes a rising circumferential wall portion 21 stretching out from the radial inner side of the bottle at the grounding portion 18 to extend upward, an annular movable wall portion 22 protruding from an upper end of the rising circumferential wall portion 21 toward the radial inner side of the bottle, and a recessed circumferential wall portion 23 extending upward from a radial inner end of the bottle of the movable wall portion 22.

The rising circumferential wall portion 21 is gradually reduced in diameter from a lower side toward an upper side thereof.

The movable wall portion 22 is formed in the shape of a curved surface protruding downward, and gradually extends downward from the radial outer side toward the radial inner side of the bottle. The movable wall portion 22 and the rising circumferential wall portion 21 are connected via a curved surface part 25 protruding upward. Thus, the movable wall portion 22 is free to rotate about the curved surface part 25 (the connected portion with the rising circumferential wall portion 21) so as to move the recessed circumferential wall portion 23 in an upward direction.

As shown in FIG. 2, a plurality of ribs 26 is radially disposed around the bottle axis O at the movable wall portion 22. In the example of FIG. 2, the ribs 26 extend intermittently and straightly in the radial directions of the bottle. Further, the ribs 26 are recessed in an upward direction.

The recessed circumferential wall portion 23 is disposed on the same axis as the bottle axis O, and is gradually increased in diameter from an upper side toward a lower side thereof, as shown in FIG. 3. A disc-shaped top wall 24 disposed on the same axis as the bottle axis O is connected to an upper end of the recessed circumferential wall portion 23, and the recessed circumferential wall portion 23 and the top wall 24 have the shape of a topped cylinder as a whole. Further, the recessed circumferential wall portion 23 is formed in a circular shape when viewed from the cross section. In addition, the recessed circumferential wall portion 23 is configured so that a plurality of curved walls 23*a*, each of which is formed in the shape of a curved surface protruding toward the radial inner side of the bottle, are connected via a bent section 23*b* in the direction of the bottle axis O.

In the present embodiment, in the heel portion 17, a lower heel edge portion 27 stretching out from the radial outer side of the bottle at the grounding portion 18 is formed so as to have a smaller diameter than an upper heel portion 28 stretching out from the upper side at the lower heel edge portion 27. The upper heel portion 28 is connected to the body portion 13. Further, the aforementioned fourth annular concave groove 31 is formed in the upper heel portion 28. In addition, each of the lower heel edge portion 27 and the upper heel portion 28 has the same outer diameter throughout the length of the direction of the bottle axis O.

Moreover, in the present embodiment, a connection part 29 of the lower heel edge portion 27 and the upper heel portion 28 is gradually reduced in diameter from an upper side toward a lower side thereof. Further, the connection part 29 extends in a linear shape in a direction inclined to the bottle axis O when viewed from the longitudinal cross section.

The lower heel edge portion 27 and the rising circumferential wall portion 21 are configured so that upper end positions thereof are equal to each other. A difference between an outer diameter of the lower heel edge portion 27 and an outer diameter of the upper heel portion 28 is appropriately changed by the size or shape of the bottle 1. However, the difference set to, for instance, about 0.5 mm to about 2.0 mm (about 1.0 mm in the present embodiment) may be favorable from the viewpoint of moldability (formativeness).

In the present embodiment, the rising circumferential wall portion 21 is formed with an uneven section 30 over the entire circumference thereof. The uneven section 30 is configured so that, when viewed from the bottom of the bottle 1 as shown in FIG. 2, bulges 30*a* formed in the shape of a curved surface protruding toward the radial inner side of the bottle are connected in a circumferential direction of the bottle. Moreover, in the present embodiment, as shown in FIG. 3, a lower end of each bulge 30*a* stretches out from the radial inner side of the bottle at the grounding portion 18. Further, an upper end of each bulge 30*a* is located below an upper end of the rising circumferential wall portion 21. Furthermore, a radial inner end of the bottle in the bulge 30*a* is located at the radial outer side of the bottle from the curved surface part 25 connecting the movable wall portion 22 and the rising circumferential wall portion 21. Further, an inner surface of the bulge 30*a* which is located inside the bottle 1 is formed in the shape of a curved surface recessed toward the radial inner side of the bottle.

As described above, according to the bottle 1 based on the present embodiment, in the heel portion 17, the lower heel edge portion 27 is formed with a smaller diameter than the upper heel portion 28. Accordingly, during blow molding of the bottle 1, sink marks can be suppressed from occurring at the lower heel edge portion 27, and the deformation of the grounding portion 18 stretching out at the lower heel edge portion 27 can be inhibited.

Further, the connection part 29 of the lower heel edge portion 27 and the upper heel portion 28 is gradually reduced in diameter from the upper side toward the lower side thereof. As a result, good moldability is secured, and the aforementioned effects are reliably accomplished.

Moreover, in the present embodiment, the uneven section 30 is formed on the rising circumferential wall portion 21. For this reason, it is possible to suppress a sense of incompatibility felt when the bottom portion 14 of the bottle 1 is viewed from an outer side of the bottle 1 in which the contents are filled, for example, because rays incident upon the rising circumferential wall portion 21 are subjected to irregular reflection by the uneven section 30 or because the contents are filled even in the uneven section 30.

Further, the lower end of each bulge 30*a* of the uneven section 30 stretches out from the radial inner side of the bottle at the grounding portion 18. For this reason, when the bottle 1 stands on its own, both the grounding portion 18 and the lower end of each bulge 30*a* are allowed to come into contact with a ground-contact surface, and the ground-contact stability can also be improved.

The technical scope of the present invention is not limited to the embodiment, but the present invention may be modified in various ways without departing from the spirit thereof.

For example, in the present embodiment, the ribs 26 are formed on the movable wall portion 22. However, the ribs 26 may not be formed. Further, the ribs 26 may extend continuously, extend curvedly, or protrude downward.

Moreover, the uneven section 30 may not be formed on the rising circumferential wall portion 21. The form of the uneven section 30 may be appropriately changed without being limited to the embodiment.

In addition, the rising circumferential wall portion 21 may be appropriately changed, for instance, may extend in parallel along the direction of the bottle axis O.

Moreover, the movable wall portion 22 may be appropriately changed, for instance, may extend in parallel along the radial direction of the bottle.

Further, the recessed circumferential wall portion 23 may be appropriately changed, for instance, may extend in parallel along the direction of the bottle axis O, and the top wall 24 may not be disposed.

Moreover, the uneven section 17*a* may not be formed. Further, the reinforcement protrusion 15*a* may not be disposed in the second annular concave groove 15.

Further, the synthetic resin material of which the bottle 1 is formed may be appropriately changed, and for instance, may include polyethylene terephthalate, polyethylene naphthalate, amorphous polyester, or a blended material thereof, or may be formed in a layered structure.

Furthermore, in the aforementioned embodiment, each of the shoulder portion 12, the body portion 13, and the bottom portion 14 of the bottle 1 is configured to have the circular shape when viewed from the cross section perpendicular to the bottle axis O. The shape is not limited to this shape, but may be appropriately changed, for instance, into a polygonal shape.

Further, in the aforementioned embodiment, it is shown that each of the lower heel edge portion 27 and the upper heel portion 28 is configured so that the diameter thereof is the same over the entire length of the direction of the bottle axis O. However, instead of this configuration, a configuration in which the diameter is gradually reduced from one side toward the other side of the direction of the bottle axis O, or a configuration in which an inclined cylindrical part whose diameter is gradually reduced from one side toward the other side of the direction of the bottle axis O and a circular cylindrical part whose diameter is the same over the entire length of the direction of the bottle axis O are connected in the direction of the bottle axis O may be used. Thus, the configuration may also have a different diameter at each position in the direction of the bottle axis O.

Further, even in this case, the lower heel edge portion 27 is configured to have a smaller diameter than the upper heel portion 28, and the maximum diameter part of the lower heel edge portion 27 is formed with a smaller diameter than the minimum diameter part of the upper heel portion 28.

In addition, the components in the embodiment described above may be appropriately substituted with well-known components without departing from the spirit of the present invention. Further, the modifications described above may be appropriately combined.

INDUSTRIAL APPLICABILITY

Since the lower heel edge portion is formed with a smaller diameter than the upper heel portion, the sinks can be prevented from occurring at the lower heel edge portion during blow molding of the bottle.

REFERENCE SIGNS LIST

1 bottle
13 body portion
14 bottom portion
17 heel portion
18 grounding portion
19 bottom wall portion
21 rising circumferential wall portion
22 movable wall portion
23 recessed circumferential wall portion
25 curved surface part (connected portion)
27 lower heel edge portion
28 upper heel portion
29 connection part
O bottle axis

The invention claimed is:

1. A bottle made from synthetic resin material and formed by blow-molding in a cylindrical shape having a bottom portion, the bottle comprising:

the bottom portion including:

a heel portion which is connected to a body portion; and a bottom wall portion having a grounding portion, the bottom wall portion closing the heel portion, wherein the bottom wall portion includes:

a rising circumferential wall portion continuing into the ground portion from an inside in a radial direction of the bottle and extending upward;

a movable wall portion having an annular shape and protruding toward the inside in the radial direction of the bottle from an upper end portion of the rising circumferential wall portion; and a recessed circumferential wall portion extending upward from an inner edge portion of the movable wall portion in the radial direction of the bottle;

the movable wall portion is freely rotatably provided having a connected portion with the rising circumferential wall portion as a center so as to move the recessed circumferential wall portion upward;

the heel portion includes a lower heel edge portion continuing into the grounding portion, an upper heel portion connected to the body portion, and a connection part connecting the lower heel edge portion and the upper heel portion;

the upper heel portion has the same outer diameter throughout a length direction of the bottle;

the lower heel edge portion has the same outer diameter throughout the length direction of the bottle and is formed in a smaller diameter than the upper heel portion; and the connection part is gradually reduced in diameter from an upper side toward a lower side of the connection part.

2. The bottle according to claim 1, wherein an outer circumferential surface of the entire heel portion is formed with an uneven section configured to inhibit an occurrence of blocking.

* * * * *